United States Patent [19]

Steiger

[11] 4,006,668

[45] Feb. 8, 1977

[54] HYDROSTATIC PISTON MACHINE HAVING A CYLINDRICAL MOUNTING PIN

[75] Inventor: Anton Steiger, Illnau, Switzerland

[73] Assignee: Sulzer Brothers Limited, Winterthur, Switzerland

[22] Filed: Oct. 17, 1974

[21] Appl. No.: 515,540

[30] Foreign Application Priority Data

Oct. 23, 1973 Switzerland ..... 14907/73

[52] U.S. Cl. ..... 91/497; 91/498

[51] Int. Cl.[2] ..... F01B 13/06

[58] Field of Search ..... 91/493–498, 91/488

[56] References Cited

UNITED STATES PATENTS

| | | | |
|---|---|---|---|
| 1,818,611 | 8/1931 | Ernst | 91/497 |
| 3,520,233 | 7/1970 | Tobias | 91/495 |
| 3,709,104 | 1/1973 | Colberson | 91/495 |
| 3,777,624 | 12/1973 | Axon | 91/488 |
| 3,785,250 | 1/1974 | Steiger | 91/497 |

FOREIGN PATENTS OR APPLICATIONS

| | | | |
|---|---|---|---|
| 550,396 | 10/1956 | Italy | 91/497 |
| 245,783 | 8/1947 | Switzerland | 91/495 |
| 393,924 | 8/1961 | Switzerland | 91/495 |
| 215,820 | 4/1968 | U.S.S.R. | 91/498 |

*Primary Examiner*—William L. Freeh
*Attorney, Agent, or Firm*—Kenyon & Kenyon Reilly Carr & Chapin

[57] ABSTRACT

The machine has a cylindrical pin mounted at each end in a guide device which is movable so as to change the eccentricity of the guide member axis relative to the pin axis. The guide member is connected over a toothing to a shaft for receiving or taking off power. The toothing can be formed on the outer periphery of the guide member or on a gearwheel secured to a side of the guide member. The guide device may either be of a pivotal type or a slidable type.

5 Claims, 5 Drawing Figures

42
43
8'
10'
40
45
41
44
2
17'
15
45
15
16
25
26

HYDROSTATIC PISTON MACHINE HAVING A CYLINDRICAL MOUNTING PIN

This invention relates to a hydrostatic piston machine having an adjustably mounted pin.

Hydrostatic piston machines have been known in which a cylinder block is rotatably mounted about a pin or pivot and in which pistons are guided. The pistons are usually distributed radially of the pin at the periphery of the cylinder block and, at their outer ends, have feet with plane bearing surfaces guided along plane guide surfaces of a guide member. The guide surfaces are usually disposed tangentially with respect to a circular cylindrical surface which is eccentric of the cylinder block axis, the guide member being mounted on the pin so as to rotate about the axis of the circular cylindrical surface. A piston machine of this kind is known, for example, from German Offenlegungsschrift 2,134,944. However, in machines of this type, the cylinder block is mounted on a pin secured to one side of a casing. Because these machines may act either as a motor or a pump, relatively heavy loadings may occur which impart bending deformations on the pin. In order to compensate for this, the bearing surface between the pin and cylinder block must be spherical. Thus, the machines have been complicated and relatively expensive.

Accordingly, it is an object of the invention to provide a piston machine in which a cylinder block can be mounted on a cylindrical pin to withstand high loadings.

It is another object of the invention to provide a hydrostatic piston machine of simple construction.

Briefly, the invention provides a hydrostatic piston machine which has a casing, a pin mounted in the casing, and a guide means at each end of the pin on the outside of the casing mounting the pin relative to the casing. The pin passes through apertures in a pair of opposed sidewalls of the casing and has a cylinder block rotatably mounted thereon within the casing. In addition, a guide member is rotatably mounted about the pin in the casing and has guide surfaces disposed tangentially with respect to a circular cylinder having an axis eccentric to the pin axis. The guide means for the pin serves to adjust the eccentricity of the pin axis to the axis of the guide surface of the guide member.

The cylinder block, as is known, has a plurality of pistons movably mounted in a circumferentially array radially of the block. Each piston has a foot at an outer end which has a plane bearing surface disposed in guided relation on a guide surface of the guide member.

The guide means for the pin can be in the form of a pair of pivotally mounted interconnected levers in which the ends of the pin are received. Alternatively, the guide means can be in the form of a pair of parallel guides mounted for rectilinear movement.

In one embodiment, the guide member has a toothing for supplying torque to the machine or removing torque therefrom which meshes with a gearwheel mounted in the casing. As a result of this, the guide member is given a power connection in a very simple manner, without causing constructional difficulties due to the pin being mounted on both sides. The toothing can be disposed on the outer periphery of the guide member or on a gearwheel rigidly connected to a hollow pin of the guide member. The former embodiment is more particularly suitable for instances in which the diameter of the gearwheel is smaller than the toothing on the guide member, while the second embodiment is suitable for cases in which the diameter of the gearwheel is greater.

These and other objects and advantages of the invention will become more apparent from the following detailed description and appended claims taken in conjunction with the accompanying drawings in which:

Figure 1:
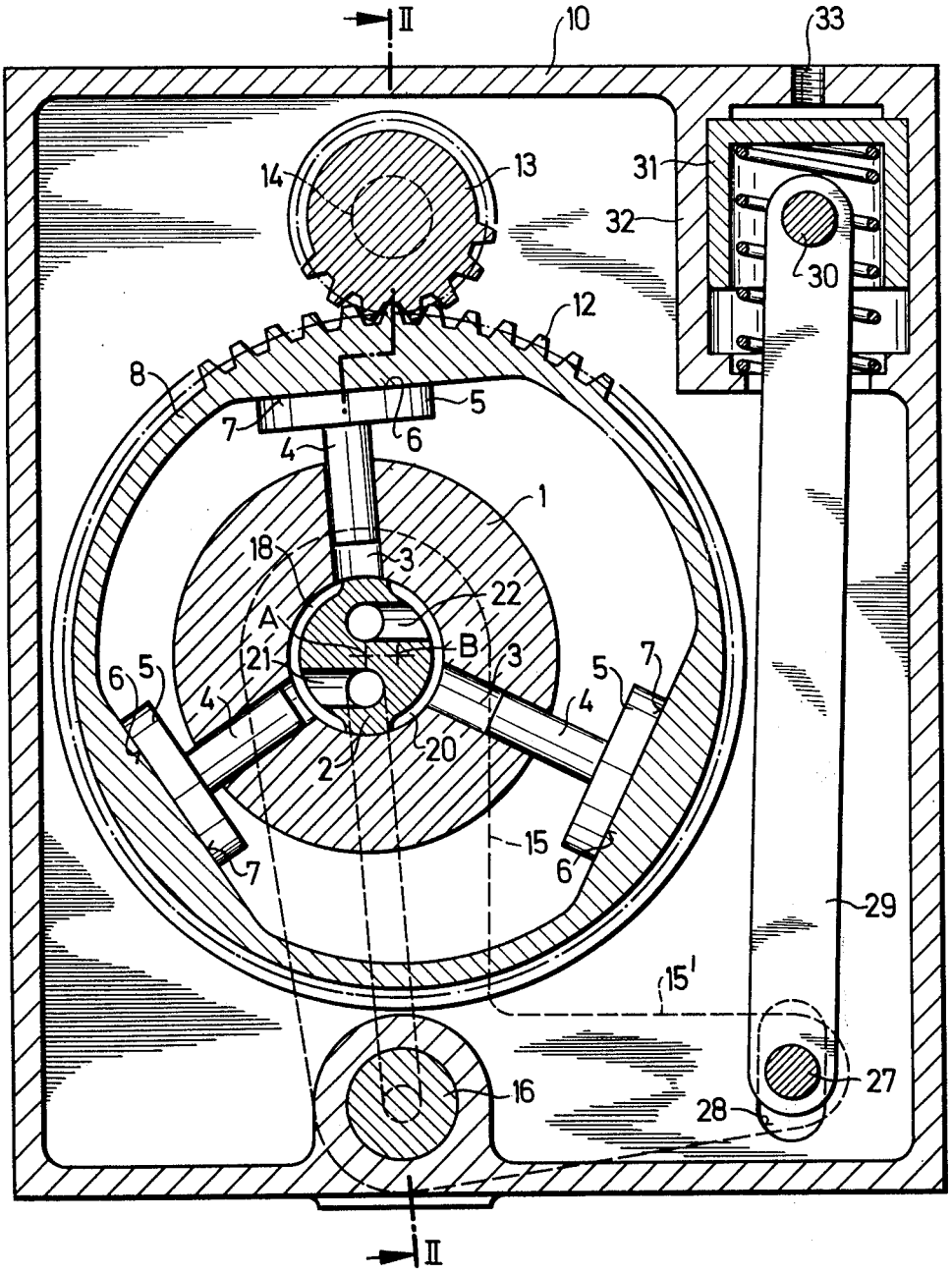
FIG. 1 illustrates a longitudinal section through a casing of a piston machine according to the invention taken along line I—I of FIG. 2.

In the drawings like members have like references.

Figure 2:
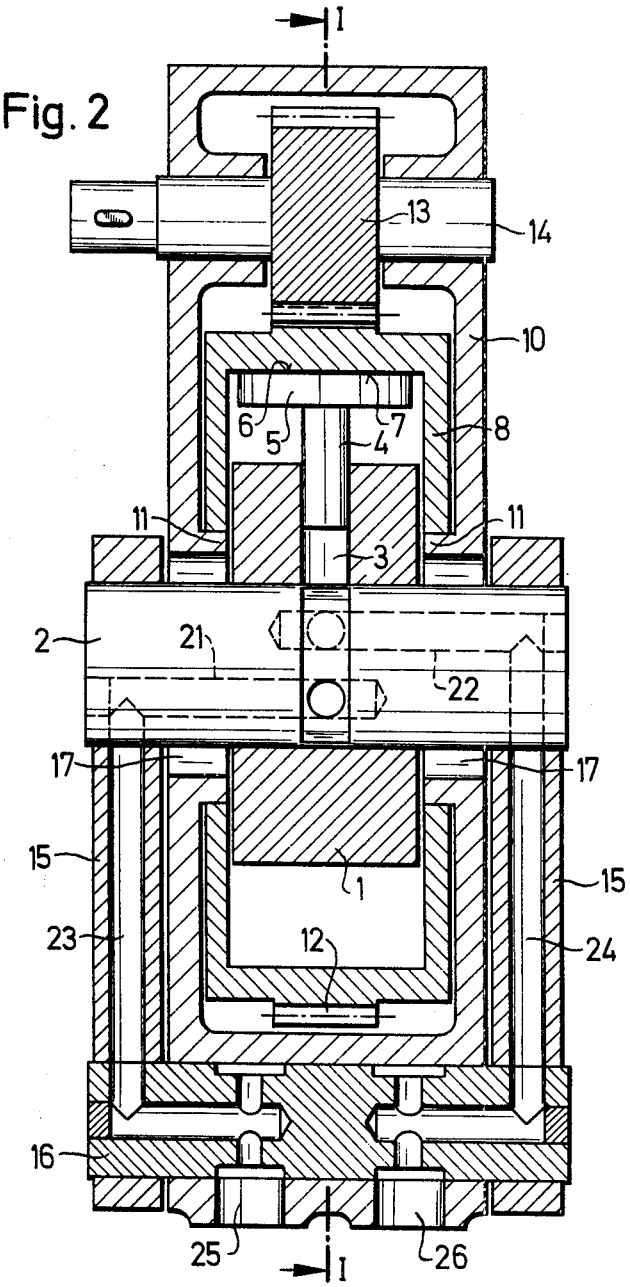
FIG. 2 illustrates a view taken along line II—II of FIG. 1.

Referring to FIGS. 1 and 2, a hydrostatic piston machine has a cylinder block 1 which can pivot around a pin 2 having an axis A. A plurality of pistons 4 extend radially in bores 3 in the cylinder block 1 in a known manner. Each piston 4 has a foot 5 at the outer end with a plane bearing surface 6 which is guided along a plane bearing surface 7 of a drum-shaped guide member 8. The guide surfaces 7 are disposed in known manner tangentially of a circular cylindrical surface having an axis B which is eccentric of the axis A of the cylinder block 1. The guide member 8 is rotatably mounted in a casing 15 by means of cylindrical projections 11 which are coaxial with the axis B. The outer periphery of the guide member 8 has a toothing 12 meshing with the gearwheel 13 whose shaft 14 is mounted in the casing 10.

The pin 2 is attached to a guide means which serves to mount the pin 2 within the casing 10 for adjusting the eccentricity of the pin axis B to the cylinder block axis B. As shown in FIGS. 1 and 2, the guide means includes a pair of levers 15 on the outside of the casing 10 which are pivotably mounted relative to the casing 10 by means of a common pin 16 and are rigidly interconnected. The pin 2 is secured at each end outside the casing 10 to a respective lever 15. In order to produce the necessary mobility of the pin 2 if the eccentricity of the machine, i.e. the distance between the axes A and B changes, the casing 10 is formed on both sides with coaxial apertures 17 in the sidewalls. The apertures 17 are round and coaxial with the projections 11 and are of larger diameter than the pin 2.

As shown by FIGS. 1 and 2, the pin 2 has ducts 18, 20 and bores 21, 22 which are connected to the ducts 18, 20 and via which, in known manner, hydraulic pressure medium is supplied to and removed from the cylinders 3, respectively. The bores 21, 22 are connected to bores 23, 24 extending through the levers 15 and pin 16. The bores 23, 24 are connected to connection apertures 25, 26 for the corresponding connection lines.

As shown in FIG. 1, the levers 15 are toggle levers with bent arms 15′ interconnected via pin 27. The pin 27 extends through elongate apertures 28 in the side walls of the casing 10. Engaging with the pin 27 is a rod 29 connected via a piston pin 30 to a piston 31 of a hydraulic adjusting cylinder 32. Hydraulic pressure medium can be fed to the cylinder 32 via a connection bore 33 in order to move the piston 31 against the force of a biasing spring.

In operation, hydraulic pressure medium is fed through one of the connection bores 25, 26 and removed through the other bore. The machine can operate either as a pump or a motor. If the machine operates as a pump, the torque is supplied by the shaft 14. In operation as a motor, the torque is taken from the shaft 14. If, during operation, the eccentricity of the machine is to be changed, for instance, to change the delivery rate in pump operation, the guide device formed by the levers 15, 15' is adjusted by the hydraulic adjusting motor 31, 32. Zero eccentricity can also be obtained by positioning the axis A of the cylinder block in the axis B of the guide member 8.

The fact that the pin 2 is mounted on both sides obviates the need to use a spherical pin for the cylinder block 1. Thus, the block 1 can be mounted on the cylindrical pin 2 even for the highest pressures.

Figure 3:
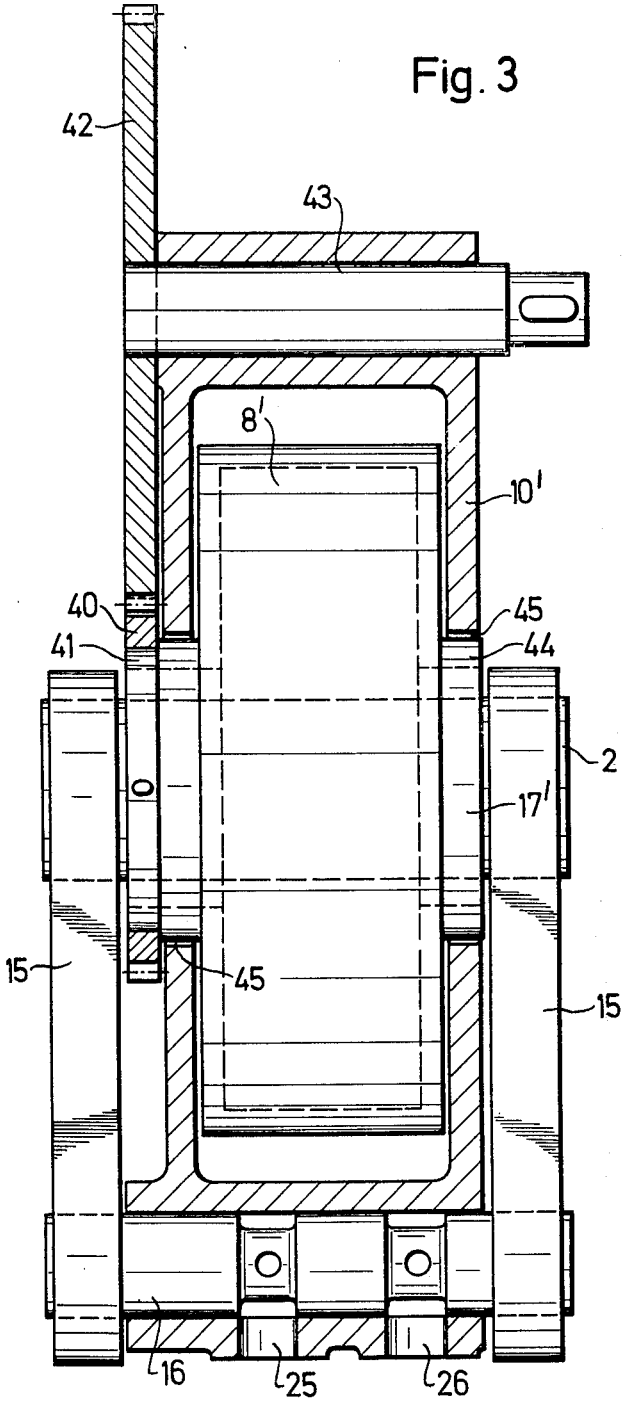
FIG. 3 illustrates a sectional view corresponding to FIG. 2 of a modified machine according to the invention.

Referring to FIG. 3, the piston machine can be modified to have the toothing of the guide member 8' on a gearwheel 40 attached to a hollow pin 41 of a guide member 8'. The gearwheel 40 meshes with a gearwheel 42 whose shaft 43 is mounted in a casing 10'. Unlike the embodiment illustrated in FIGS. 1 and 2, the guide member 8' is mounted not on annular projections, but in cylindrical bores 45 of the casing 10' by means of the hollow pin 41 and a hollow pin 44. Otherwise, the pin 2 is borne in a similar manner as in the embodiment illustrated in FIGS. 1 and 2 on levers 15 interconnected via a pin 16.

Figure 4:
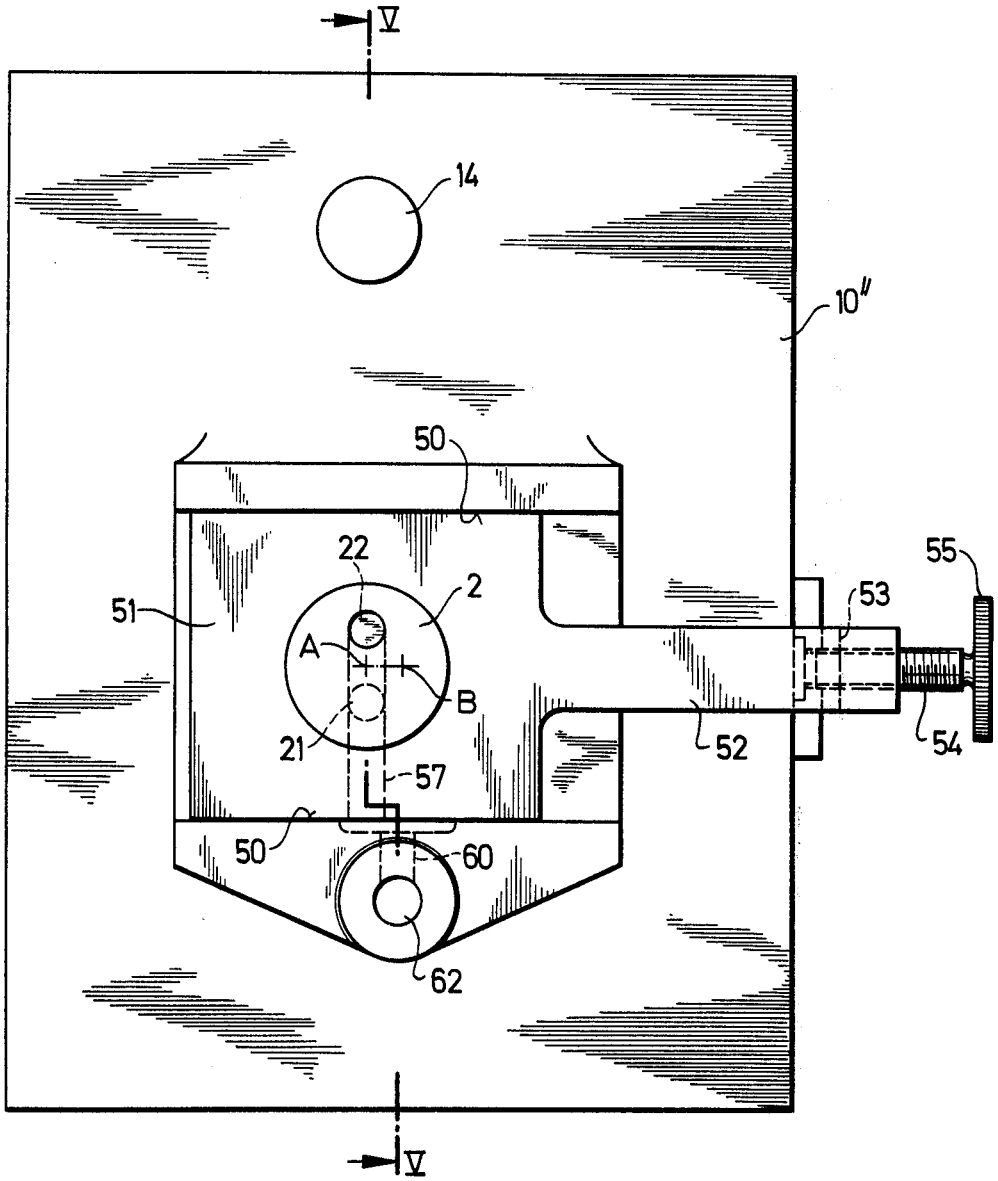
FIG. 4 illustrates a side view of a further embodiment of the piston machine using parallel guides for the pin.
Figure 5:
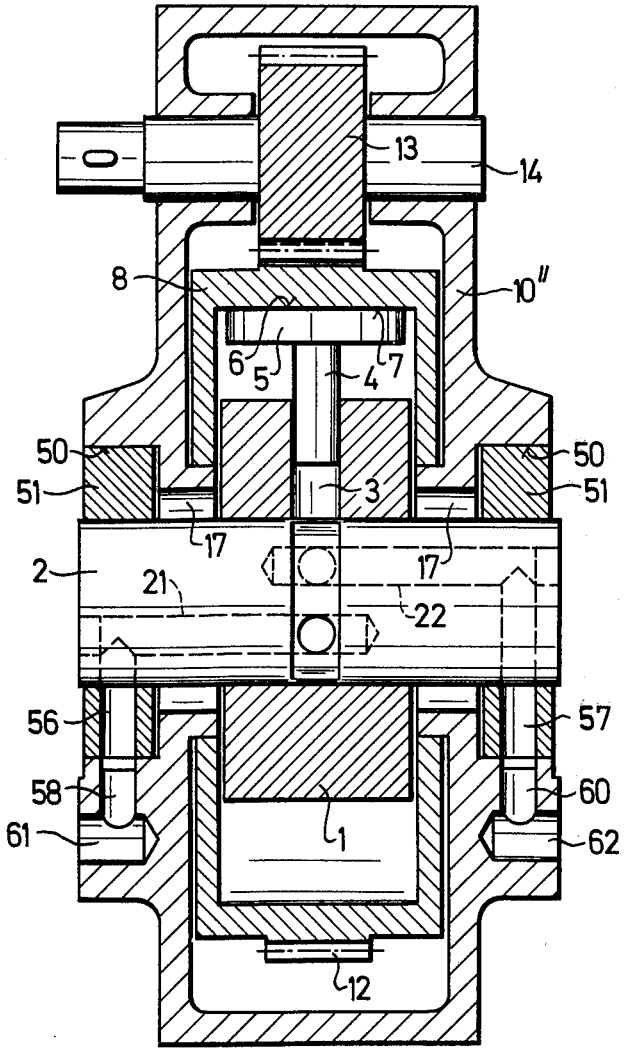
FIG. 5 illustrates a sectional view taken along line V—V of FIG. 4.

Referring to FIGS. 4 and 5, the guide device for the pin 2 can alternatively be in the form of non-pivotable parallel guides which allow rectilinear movement. To this end, in the machine illustrated in FIGS. 4 and 5, two guideways 50 are provided on both sides of the casing 10'' and a guide block 51 is guided in each of the guideways 50. The ends of the pin 2 are attached in the two guide blocks 51, which are interconnected via longitudinal rods 52 and a transverse rod 53. The guide blocks 51 are adjusted by means of a screwthreaded rod 54 whose end is pivotably mounted in the casing 10'' and which is screwed into a screwthreading of the transverse rod 53. The screwthreaded rod 54 has an adjusting wheel 55 to rotate the rod 54 and therefore adjust the distance between the axes A and B. In this case, the blocks 51 are formed with bores 56, 57 and the casing 10'' is formed with corresponding bores 58, 60 for the connection of the ducts 21, 22 of the pin 2 to a suitable source of pressure medium via apertures 61, 62.

In all the embodiments of the machine illustrated, the axis A of the cylinder block 1 can make an adjusting movement via the axis B of the guide member 8, 8' to the other side. In this way, for instance, the flow of the pressure medium through the machine can be reversed.

Clearly, in the embodiment illustrated in FIG. 3, the inside diameter of the hollow pins 41, 44 must be large enough to produce an aperture 17' allowing adequate clearance for the movement of the pin 2. In this way, the pin 2 can at the same time also move indirectly in the bores 45 of the casing 10'.

The elements used for adjusting the guide devices in the different embodiments are merely given as examples. For instance, in the embodiment illustrated in FIGS. 4 and 5, adjustment can be performed by a hydraulic cylinder, in the embodiments illustrated in FIGS. 1 to 3 adjustment can be performed by a screwthreaded rod and, in general, similar elements can be used.

What is claimed is:

1. A hydrostatic piston machine comprising a casing having a pair of opposed sidewalls, each sidewall having an aperture coaxially aligned with the aperture in the other sidewall;

a pin passing through said apertures and said casing and having a longitudinal axis;

a cylinder block within said casing rotatably mounted on said pin about said axis;

a guide member rotatably mounted about said pin in said casing, said guide member having guide surfaces disposed tangentially with respect to a circular cylinder having a second axis eccentric to said axis of said pin;

a plurality of pistons movably mounted in said cylinder block radially of said block, each said piston having a foot at an outer end, each said foot having a plane bearing surface disposed in guided relation on a respective guide surface of said guide member; and a guide means at each end of said pin on the outside of said casing mounting said pin relative to said casing for adjusting the eccentricity of said pin axis to said second axis, said guide means including a pair of pivotally mounted interconnected levers, each lever receiving one respective end of said pin therein.

2. A hydrostatic piston machine as set forth in claim 1 wherein said pin is cylindrical and each said aperture of said sidewalls is of a diameter larger than the diameter of said pin.

3. A hydrostatic piston machine as set forth in claim 1 which further comprises a toothing on said guide member and a gearwheel mounted in said casing in meshing engagement with said toothing whereby a torque may be supplied to or removed from said machine.

4. A hydrostatic piston machine as set forth in claim 3 wherein said toothing is on an outer periphery of said guide member.

5. A hydrostatic piston machine as set forth in claim 3 which further comprises a gearwheel secured to said guide member and wherein said toothing is on said gearwheel.

* * * * *